US010858906B2

(12) United States Patent
Saraya

(10) Patent No.: US 10,858,906 B2
(45) Date of Patent: Dec. 8, 2020

(54) METHODS AND SYSTEMS FOR A TEMPORARY SEAL WITHIN A WELLBORE

(71) Applicant: Vertice Oil Tools, Missouri City, TX (US)

(72) Inventor: Mohamed Ibrahim Saraya, Sugar Land, TX (US)

(73) Assignee: Vertice Oil Tools, Missouri City, TX (US)

( * ) Notice: Subject to any disclaimer, the term of this patent is extended or adjusted under 35 U.S.C. 154(b) by 0 days.

(21) Appl. No.: 16/560,574

(22) Filed: Sep. 4, 2019

(65) Prior Publication Data

US 2020/0131879 A1 Apr. 30, 2020

Related U.S. Application Data

(60) Provisional application No. 62/750,903, filed on Oct. 26, 2018.

(51) Int. Cl.
*E21B 33/12* (2006.01)
*E21B 34/06* (2006.01)

(52) U.S. Cl.
CPC ..... *E21B 33/1208* (2013.01); *E21B 34/063* (2013.01)

(58) Field of Classification Search
CPC ..... E21B 33/1208; E21B 43/28; E21B 34/063
See application file for complete search history.

(56) References Cited

U.S. PATENT DOCUMENTS 9,267,347 B2 * 2/2016 Agrawal ..... E21B 23/04
2007/0107908 A1 * 5/2007 Vaidya ..... E21B 34/14 166/376
2011/0036592 A1 2/2011 Fay
2012/0160478 A1 * 6/2012 Todd ..... E21B 33/1204 166/205
2012/0181032 A1 7/2012 Naedler
2013/0032357 A1 * 2/2013 Mazyar ..... E21B 41/00 166/376
2013/0284425 A1 * 10/2013 Agrawal ..... E21B 23/04 166/193
2014/0008085 A1 * 1/2014 Tinnen ..... E21B 29/00 166/387
2014/0216756 A1 * 8/2014 Getzlaf ..... E21B 34/063 166/376
2016/0047199 A1 * 2/2016 Hardesty ..... E21B 33/12 166/302
2016/0069462 A1 * 3/2016 Petrowsky ..... F16K 17/162 220/89.2
2016/0356137 A1 * 12/2016 Hardesty ..... E21B 43/14
2017/0204700 A1 * 7/2017 Hughes ..... E21B 34/14
2017/0247978 A1 8/2017 Budler
2017/0314359 A1 * 11/2017 Fripp ..... E21B 33/1208
2018/0371869 A1 12/2018 Kellner et al.

FOREIGN PATENT DOCUMENTS

WO WO2019164632 8/2019

OTHER PUBLICATIONS

PCT/US2019/051099 International Search Report, Parent Case, dated Nov. 18, 2019.

* cited by examiner

*Primary Examiner* — Blake E Michener
*Assistant Examiner* — Theodore N Yao
(74) *Attorney, Agent, or Firm* — Pierson IP, PLLC

(57) ABSTRACT

A temporary seal within a wellbore. More specifically, a temporary seal within casing that limits the flow of fluid through the casing until the temporary seal is released.

22 Claims, 9 Drawing Sheets

METHODS AND SYSTEMS FOR A TEMPORARY SEAL WITHIN A WELLBORE

BACKGROUND INFORMATION

Field of the Disclosure

Examples of the present disclosure relate to a temporary seal within a wellbore. More specifically, embodiments include a temporary seal within casing that limits the flow of fluid through the casing until the temporary seal is released.

BACKGROUND

Directional drilling is the practice of drilling non-vertical wells. Horizontal wells tend to be more productive than vertical wells because they allow a single well to reach multiple points of the producing formation across a horizontal axis without the need for additional vertical wells. This makes each individual well more productive by being able to reach reservoirs across the horizontal axis. While horizontal wells are more productive than conventional wells, horizontal wells are costlier.

Casing may be run through the drilled horizontal, vertical or deviated wells to reach the reservoirs across the horizontal axis. To take advantage of the buoyancy phenomena to allow moving the casing through with the lowest drag and torque, it may be more effective to not fill part of or the entire casing with fluid or fill it with lighter fluid while moving the casing towards the distal end of the horizontal well.

Accordingly, needs exist for systems and methods utilizing a temporary seal within a casing, wherein the temporary seal may be broken based on weak points positioned within the temporary seal.

SUMMARY

Embodiments disclosed herein describe systems and methods utilizing a temporary seal within a casing, tool, or any other device with an inner diameter (referred to individually and collectively hereinafter as "casing"). The temporary seal may be broken, dissolved, disengaged, or otherwise removed by increasing the pressure within the inner diameter of the casing past a pressure threshold.

A first embodiment may include a casing and temporary seal.

The casing may be configured to be installed into a well before other tools or equipment is run into the well. The casing may include a hollow channel, passageway, conduit, etc. extending from a proximal end of the casing to a distal end of the casing. The casing may be a hollow diameter pipe that is assembled and inserted into a recently drilled section of a borehole. The casing may include a cutout that increases the inner diameter across the casing, and a lower ledge may be positioned on a distal edge of the cutout. The lower ledge may decrease the inner diameter across the casing.

The temporary seal may be a disc, sphere, ball, combination, or any object that with a width that is sufficiently long to temporary block the inner diameter across the casing. The temporary seal may be comprised of a breakable, fragmentable, dissolvable, or other materials that may disappear under the influence of temperature, solvent, or flow. The temporary seal may have varying thicknesses, which may cause breakpoints at the positions that have smaller thicknesses. In embodiments, the pressure threshold associated with the breakpoints may be different than the pressure threshold associated with areas of the object with larger thicknesses. This may allow portions of the temporary seal to separate from each other in a controlled and predetermined fashion, and then travel downhole to not impede a subsequent cementing operation or other operations that may require the ability of circulations. The portions of the temporary seal may dissolve to expose a full bore diameter to allow subsequent downhole operations.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
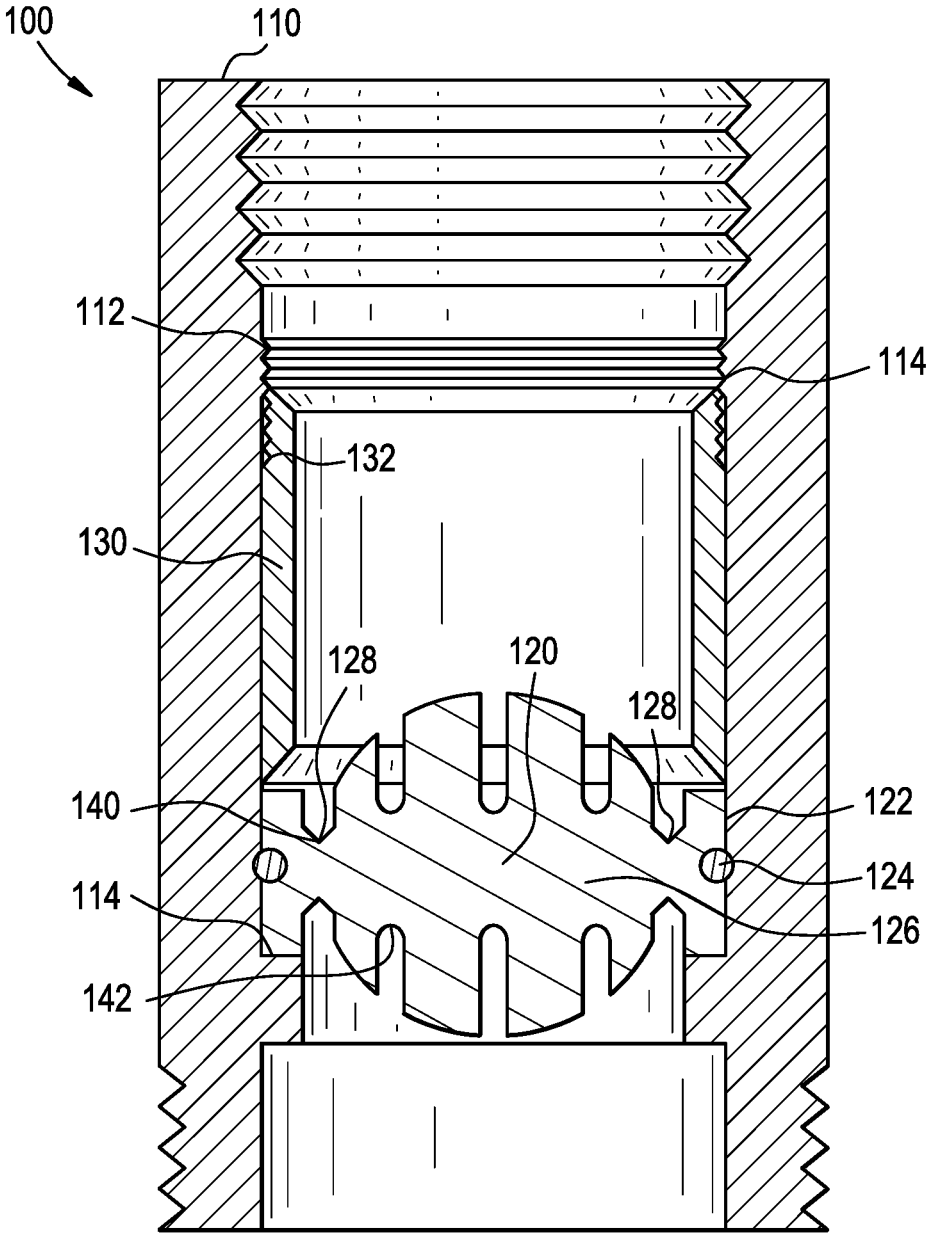
FIG. 1 depicts a blocking system, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

FIG. 1 depicts a system 100 to temporarily seal casing within a wellbore, according to an embodiment. System 100 may include casing collar 110, blocking element 120, and holding element 130 that may be of any shape, size, orientation, or configuration.

Casing collar 110 may be a casing collar that connects directly to the casing. Casing collar 110 may be made of a single, unified piece and have in inner diameter that includes first threads 112 and ledge, a no go or restriction 114 (hereinafter referred to as "ledge 114"). Threads 112 may be configured to interface with second threads 132 on holding element 130 to allow holding element 130 to move in a direction that is in parallel to the longitudinal axis of casing collar 110. Ledge 114 may be a projection, shelf, etc. that extends towards a central axis of Casing collar 110, which may decrease the inner diameter of Casing collar 110 from a first diameter positioned below or above ledge 114 to a second diameter across ledge 114. Ledge 114 may be configured to receive blocking element 120 to hold blocking element 120 in place.

Accordingly, responsive to initially positioning blocking element 120 on ledge 114, casing collar 110 may be partitioned into two zones, which are not in communication with each other.

In other art, holding element 130 may be eliminated and temporarily blocking element may be threaded, or connected directly to casing collar 110 inner diameter.

Blocking element 120 may be a disc, ball, combination, or any object that is be configured to sit on ledge 114 when blocking element 120 is intact or fully formed, and temporarily seal a wellbore. This may cause a seal within Casing collar 110, which may isolate areas above blocking element 120 to areas below blocking element 120. Responsive to portions of blocking element 120 dissolving, shearing, breaking apart, fragmented, etc. all or portions of blocking element 120 may pass ledge 114 and move downhole. Responsive to blocking element passing through ledge 114, the seal may no longer be formed across Casing collar 110. This may no longer isolate areas above and below blocking element 120. Blocking element 110 may include a first portion 122, sealing element 124, and second portion 126.

First portion 122 of block element 120 may be configured to be positioned on ledge 114. This may enable an intact and not dissolved blocking element 120 to be positioned on ledge 114. First portion 122 may be coupled to the inner diameter of casing collar 110 via seals 124. Seal 124 may be configured to restrict fluid from flowing between first portion 122 and the inner diameter of casing collar 110, in other embodiment seal 124 may be thread that seals by the act of matting. In embodiments, first portion 122 may have a first thickness. First portion 122 may also be directly coupled to second portion 126 of blocking element via break points 128.

Second portion 126 of blocking element 120 may be positioned between circumferences of first portion 122, and coupled to first portion via break points 128. Second portion 126 may include a series or ridges and grooves that result in second portion 126 have a variable thickness, and an increased surface area. The variable thickness across second portion 126 may create additional breakpoints 128, where segments of blocking element 120 may be partitioned from each other based on a pressure differential above blocking element 120 and below blocking element 120. In embodiments, the ridges and grooves may be positioned on both upper and lower surfaces of blocking element 120, wherein the grooves may be aligned with each other on both the upper and lower surfaces, in other circumstances the grooves may not be aligned. Furthermore, the series of grooves and ridges may be configured to extend in directions that are in parallel to a central axis of casing collar 110.

Breakpoints 128 within second portion may have varying thicknesses, which are smaller than the first thickness of first portion 122. The breakpoints 128 with the smallest thickness may be configured to shear partitions of second portion 126 from first portion 122, as well as other portions of second portion 126. In embodiments, the breakpoints 128 with the smallest thickness may be configured to initially couple first portion 122 with second portion 126, wherein the smallest breakpoints 128 may be configured to be positioned closer to a central axis of casing collar 110 than an inner diameter of ledge 114. This may insure that a diameter across second portion 126 is smaller than that across ledge 114. breakpoints 128 may shear blocking element 120 into different segments, fragments, etc. based on a pressure differential across a corresponding breakpoint 128, which correlates to thickness, special coating, chemical or heat treatment of the breakpoint 128. By varying the thicknesses or treatments of different breakpoints, blocking element 120 may be configured to segment at different times based on different pressure differentials across different chords of blocking element 120. Furthermore, the varying thickness of second portion 126 may increase the surface area of blocking element 120. This may allow more fluid to interact with the surface of blocking element 120, which may increase a dissolving rate of blocking element 120.

Holding element 130 may be a device that is configured to be positioned adjacent to the inner sidewalls of the casing collar 110. Holding element 130 may include threads 130 that are configured to interface with the threads 112 on the casing collar 110. Threads 132 may be configured to allow holding element 130 to be coupled with casing collar 110 and move in a direction in parallel to the longitudinal axis of casing collar 110. This may change a distance between a distal end of holding element 130 and ledge 114 to correspond to a thickness of first portion 122. Utilizing the threads, holding element 130 may move towards the distal end of casing collar 110, allowing a distal end of holding element 130 to apply forces and hold against first portion 122 of blocking element 120. Accordingly, first portion 122 of blocking element 120 may be held in place ledge 114 and holding element 130. In other embodiments, blocking element 120 can be directly connected, threaded to the inner diameter of casing collar 110 inner diameter above ledge 114. In other embodiments, holding element 130 may be an integral part of the casing collar 110, which may be split in two upper and bottom part, where the upper part contain is integral with the holding element 130, and the lower part integral with the restriction 114.

Figure 2:
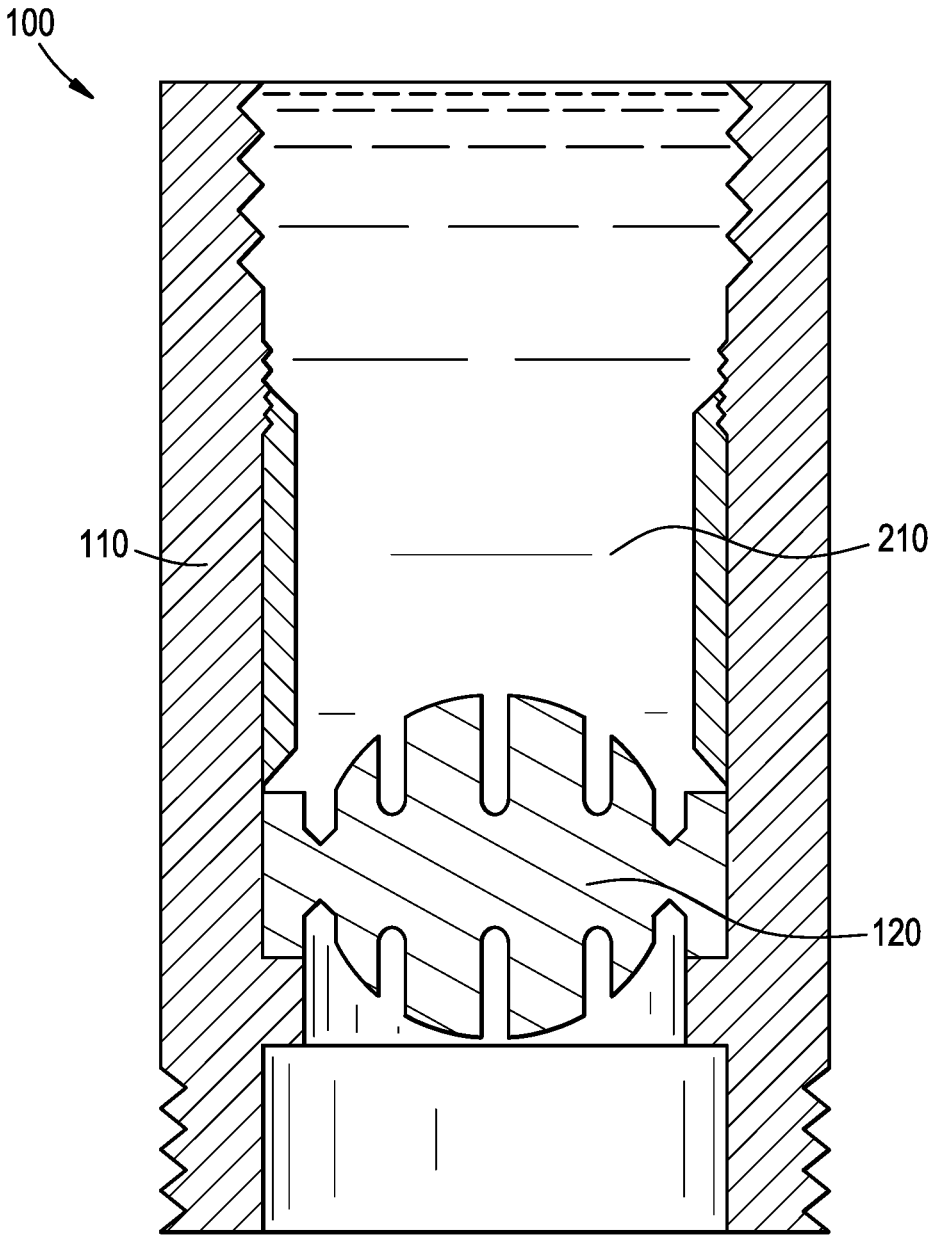
FIG. 2 depicts a blocking system, according to an embodiment.

FIG. 2 depicts system 100, according to an embodiment. Elements depicted in FIG. 2 may be described above. For the sake of brevity, another description of those elements is omitted.

As depicted in FIG. 2, responsive to flowing fluid 210 within the hollow chamber within casing collar 110, blocking element 120 may restrict the movement of the fluid through casing collar 110. Specifically, blocking element 120 may initially contain the fluid within a partition of the wellbore positioned above blocking element 120.

Figure 3:
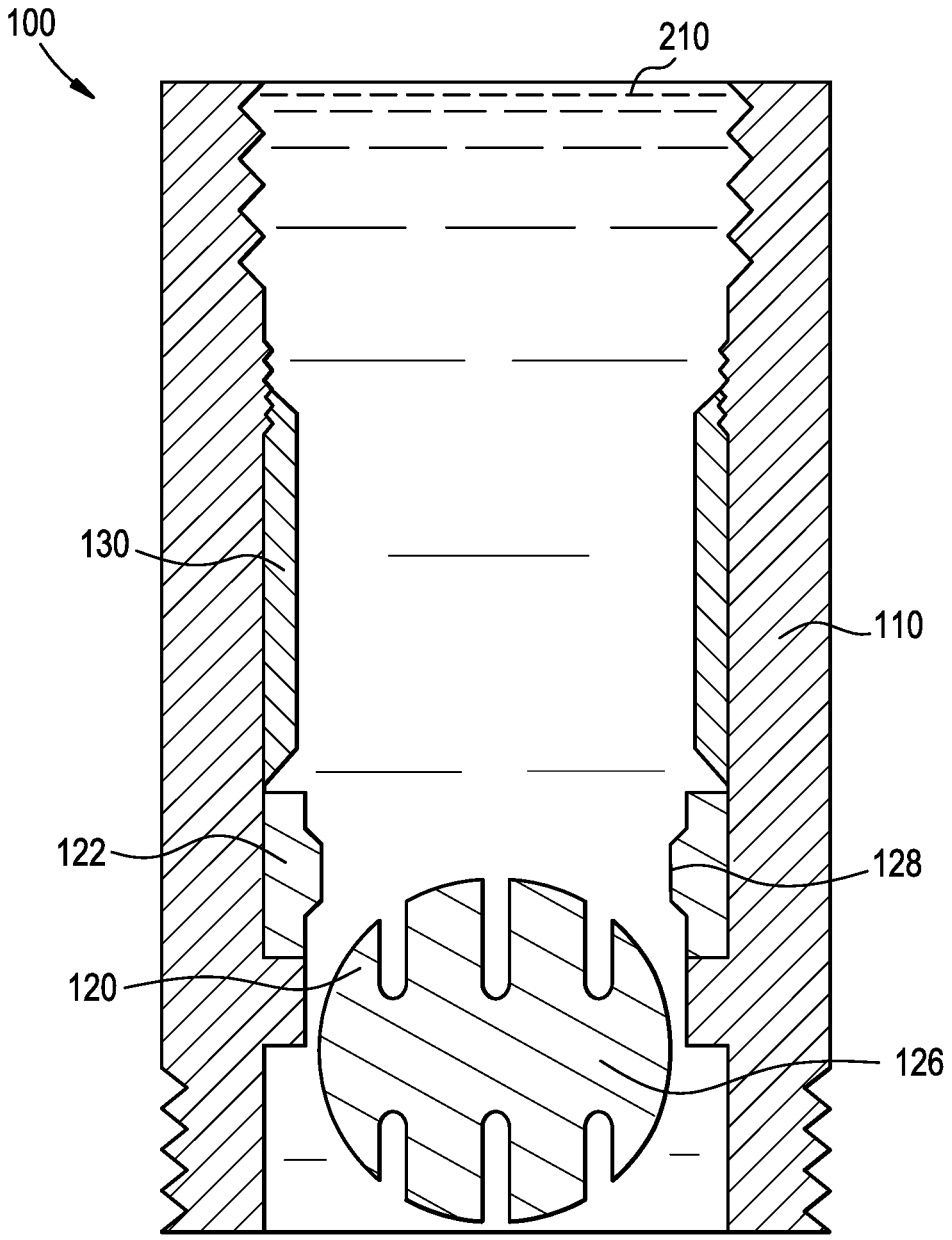
FIG. 3 depicts a blocking system, according to an embodiment.

FIG. 3 depicts system 100, according to an embodiment. Elements depicted in FIG. 3 may be described above. For the sake of brevity, another description of those elements is omitted.

As depicted in FIG. 3, responsive to the fluid 210 within the casing collar 110 above blocking element 120, the pressure applied above blocking element 120 may increase. This may create a pressure differential across breaking point 128 being greater than a breaking threshold based in part of the thickness of breaking point 128, or due to breaking point quicker dissolution of from temperature or solvent fluid. Responsive to the forces across at least a portion of blocking element being greater than a corresponding breaking threshold a first portion 122 of blocking element 120 may be separated from a second portion 126 of blocking element 120. Specifically, blocking element 120 may be partitioned at a point with the shortest thickness. This may due to the thicker portions of blocking element 120 ability to receive more stress than thinner portions of blocking element 120.

This may enable second portion 126 of blocking element 120 to be separated from first portion 122 of blocking element 120 while second portion 126 of blocking element 120 retains a substantially spherical shape. As such, first portion 122 of blocking element 120 may remain on ledge 114 even as second portion 126 is separated. Furthermore, responsive to second portion 126 of blocking element 120 being separated from first portion 122, the ridges and grooves on a lower side of second portion 126 of blocking element 120 maybe be exposed to fluid 210. This may increase a rate of dissolving/disintegration of second portion 126 of blocking element 120 since more surface area will be exposed to dissolving fluid. Also, the second portion 126 of blocking element 120 may be configured to roll down with the flow. This may cause continuous and even exposure of the dissolvable materials of blocking element 120 to the dissolving fluid, which may allow it to dissolve faster.

As a result of second portion 126 of blocking element 120 separating from first portion 122 of blocking element 120, an inner diameter of first portion 122 may have a first diameter that is exposed to the dissolving fluid, temperature, and start accelerated dissolving. This will increase the inner diameter of first portion from the first diameter to a second diameter, wherein the second diameter is larger than the first diameter.

Figure 4:
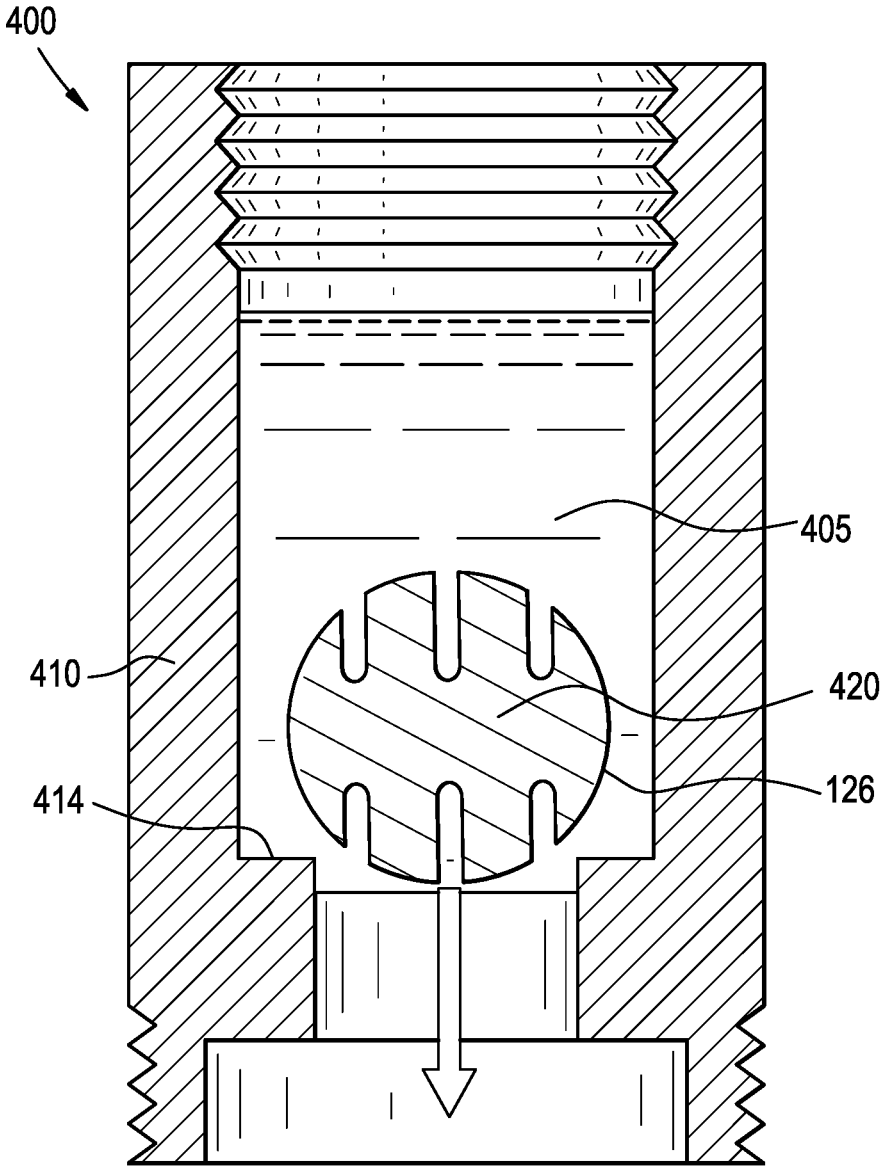
FIG. 4 depicts a blocking system, according to an embodiment.

FIG. 4 depicts system 400, according to an embodiment. Elements depicted in FIG. 4 may be described above. For the sake of brevity, another description of those elements is omitted.

As depicted in FIG. 4, a blocking element 420 flowing down hole with fluid till hit any obstruction may be positioned on a ledge 414 of casing collar 410, wherein blocking element 420 may not be secured in place. When initially positioned on ledge 414, blocking element 420 may have a first diameter, which is greater than a second diameter across ledge 414.

Figure 5:
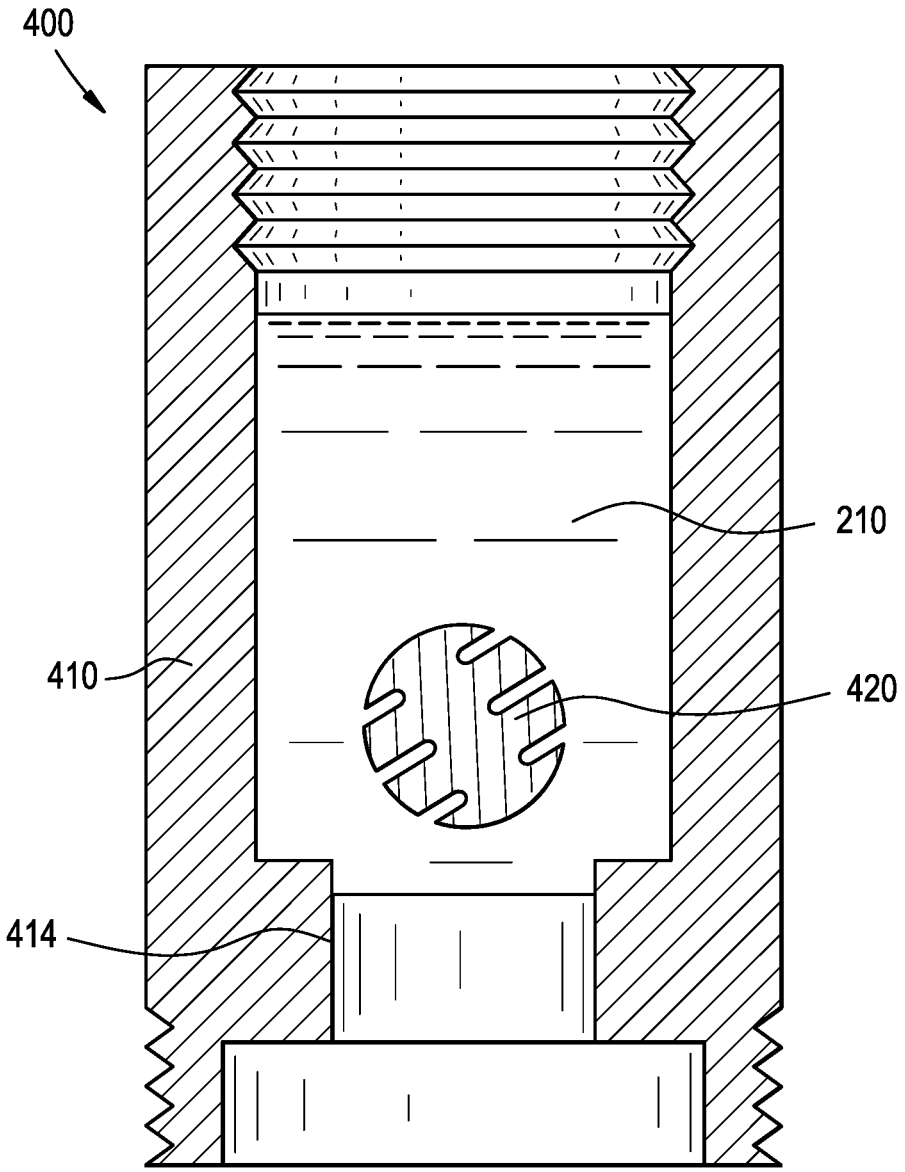
FIG. 5 depicts a blocking system, according to an embodiment.

In this embodiment, blocking element 420 may not be directly coupled to the inner sidewalls of casing 414. As such, fluid 405 may flow around blocking element 420, while blocking element 420 restricts, reduces, etc. a fluid flow rate of fluid 405 through the casing collar 410. Due to the series of ridges and grooves within blocking element 420, blocking element 420 may not be configured to fully seal the inner diameter of casing collar 410. This may be due to an upper edge of a groove being positioned above ledge 414, and a lower edge of the groove being positioned below ledge, wherein fluid may flow through the groove. This will ensure that remnant of blocking element 420 may not block or create any obstruction to flow downhole FIG. 5 depicts system 400, according to an embodiment. Elements depicted in FIG. 5 may be described above. For the sake of brevity, another description of those elements is omitted.

As depicted in FIG. 5, responsive to blocking element 420 being in contact with fluid 405 and continuous circulation and flow, portions of blocking element 420 may dissolve and disappear. This may cause the first diameter of blocking element 420 to shrink to a third diameter, wherein the third diameter is less than the second diameter associated with a distance across ledge 414. When the diameter associated with blocking element 420 is less than the diameter associated with ledge 414, blocking element 420 may flow downhole past ledge 414. As such, blocking element 420 may reduce in size while being positioned above ledge 414, then pass downhole. This process may be repeated if blocking element 420 with third diameter land on another obstruction that has a ledge inner diameter smaller than its third diameter.

Figure 6:
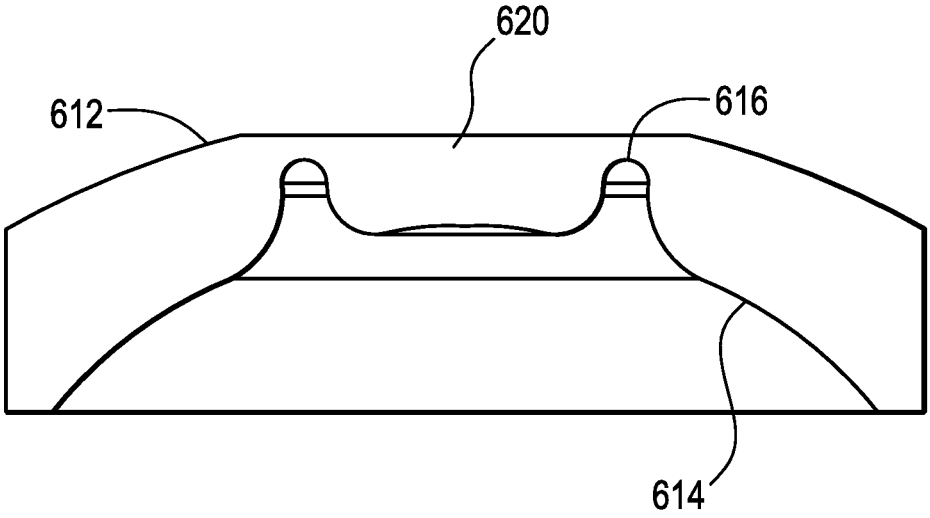
FIG. 6 depicts a blocking element, according to an embodiment.

FIG. 6 depicts blocking element 600, according to an embodiment. Elements depicted in FIG. 6 may be described above. For the sake of brevity, another description of those elements is omitted.

As depicted in FIG. 6, a blocking element 600 may be a disk with a concave downward curve, wherein blocking element 600 is shearable, dissolvable, etc. Blocking element 600 may be configured to sit on a ledge, projection etc. positioned within casing. An upper surface 612 of blocking element 600 may be configured to interface with a fluid flowing downhole through the casing, and distribute forces to other areas of blocking element 600. In embodiments, upper surface 612 may be coated with a layer that restricts, limits, reduces, etc. the dissolving rate of blocking element 600.

Lower layer 614 of blocking element 600 may include grooves 616 that decrease a thickness of between lower layer 614 and upper layer 612 of blocking element 610. In other embodiments upper layer 612 may include the grooves 616. Grooves 616 may extend from lower layer 614 towards upper layer 612. By decreasing the thickness of blocking element 610 at desired locations, the stress needed to shear different portions of blocking element 610 from each other may vary. This may enable blocking element 610 to be sheared at locations corresponding to grooves 616 where the thickness of blocking element 600 is the lowest responsive to a pressure differential across blocking element 600 increasing past a threshold corresponding with grooves 616. Accordingly, blocking element 610 may be sheared at desired locations to control the resulting partitions of blocking element 610.

In an embodiment, after the blocking element 600 is sheared, a center portion 620 of blocking element 600 between grooves 616 may remain, wherein center portion 620 is spherically or cylindrically shaped. This may facilitate the transportation of the sheared section of blocking element through a landing collar.

Figure 7:
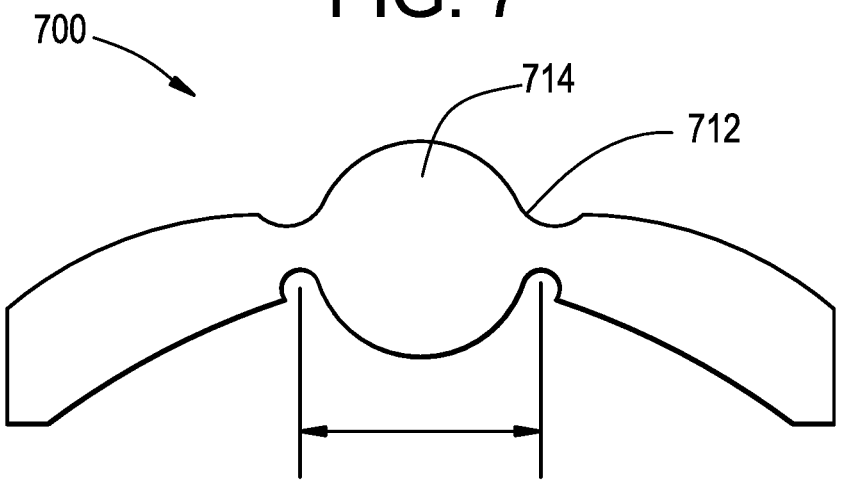
FIG. 7 depicts a blocking element, according to an embodiment.

FIG. 7 depicts blocking element 700, according to an embodiment. Elements depicted in FIG. 7 may be described above. For the sake of brevity, another description of those elements is omitted.

As depicted in FIG. 7, blocking element 700 may including grooves 712 positioned on the upper and lower surfaces of blocking element. Between the grooves may be a separable ball 814, cylindrical object, disc, etc. that is configured to be sheared at a location associated with the grooves responsive to increasing the pressure within the wellbore.

Figure 8:
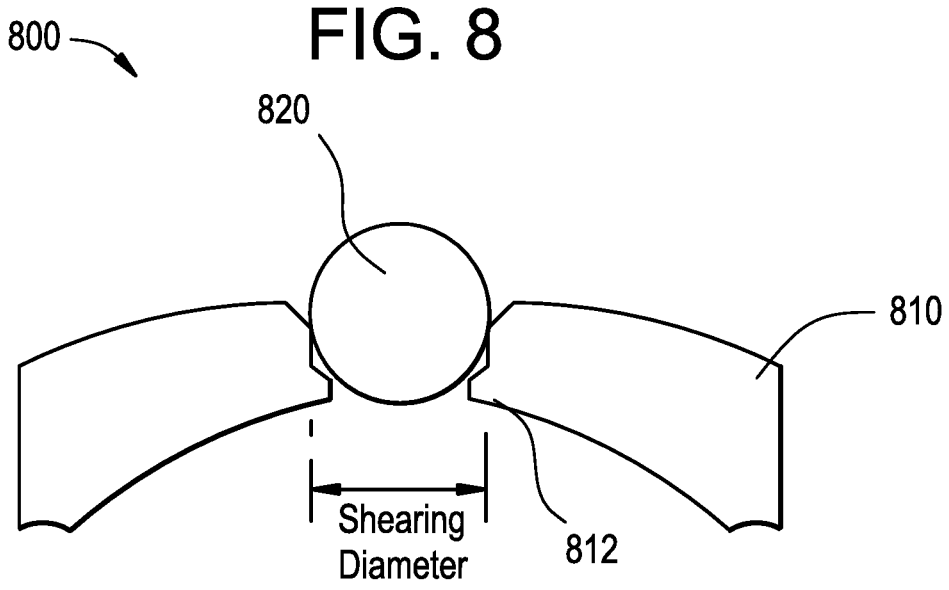
FIG. 8 depicts a blocking element, according to an embodiment.

FIG. 8 depicts blocking element 800, according to an embodiment. Elements depicted in FIG. 8 may be described above. For the sake of brevity, another description of those elements is omitted.

As depicted in FIG. 8, a blocking element 800 may include angular lead-ins 810, and a pressed-in ball 820. The lead-in 810 may be configured to have an outer circumference positioned adjacent to an inner surface of the casing, and have a hollow inner circumference 812 configured to receive ball 820. Inner circumference 812 of lead-in 810 may have a smaller thickness than that of the outer circumference of lead-in 810, such that inner circumference 812 may shear away from a body of lead-in 810. This may increase the hollow inner circumference 812 of lead-in 810 to have a larger diameter than that of ball 820, which may allow ball 820 to pass through lead-in 810.

In embodiments, the angle of lead-in 810 may have a concave downward curvature. This may aide in the passage of a cement wiper, and prevents damage to the cement wiper.

Figure 9:
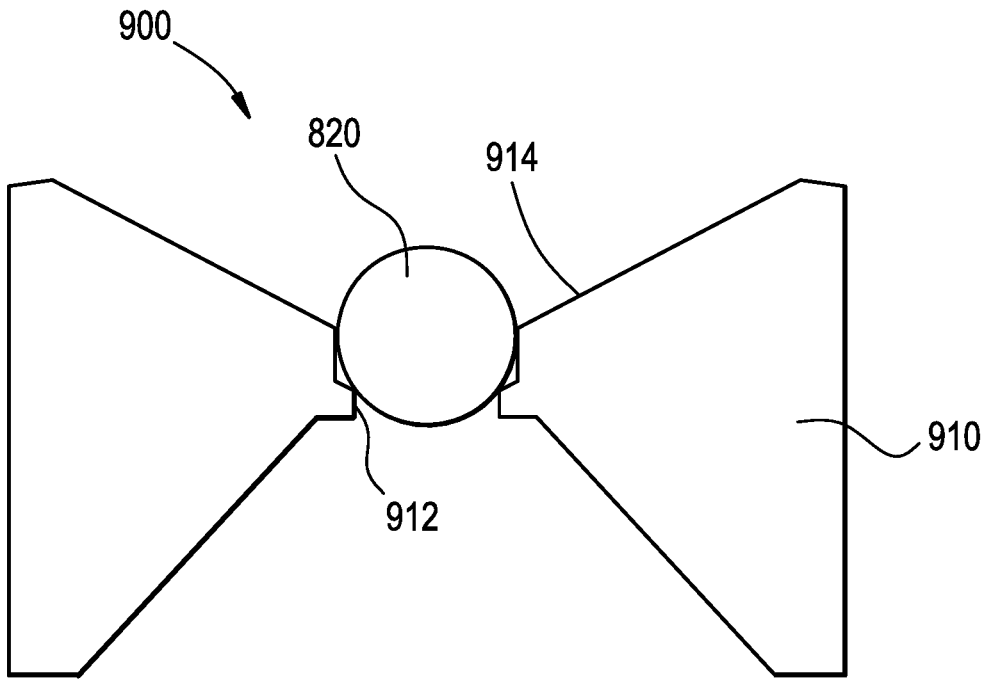
FIG. 9 depicts a blocking element, according to an embodiment.

FIG. 9 depicts blocking element 900, according to an embodiment. Elements depicted in FIG. 9 may be described above. For the sake of brevity, another description of those elements is omitted.

As depicted in FIG. 9, lead-in 910 may have a sharp lead-in angle 914 positioned between the outer circumference an inner circumference 912 of lead-in 910. This may assist guiding the nose of a cement wiper while also gradually decreasing a thickness of blocking element 900.

Figure 10:
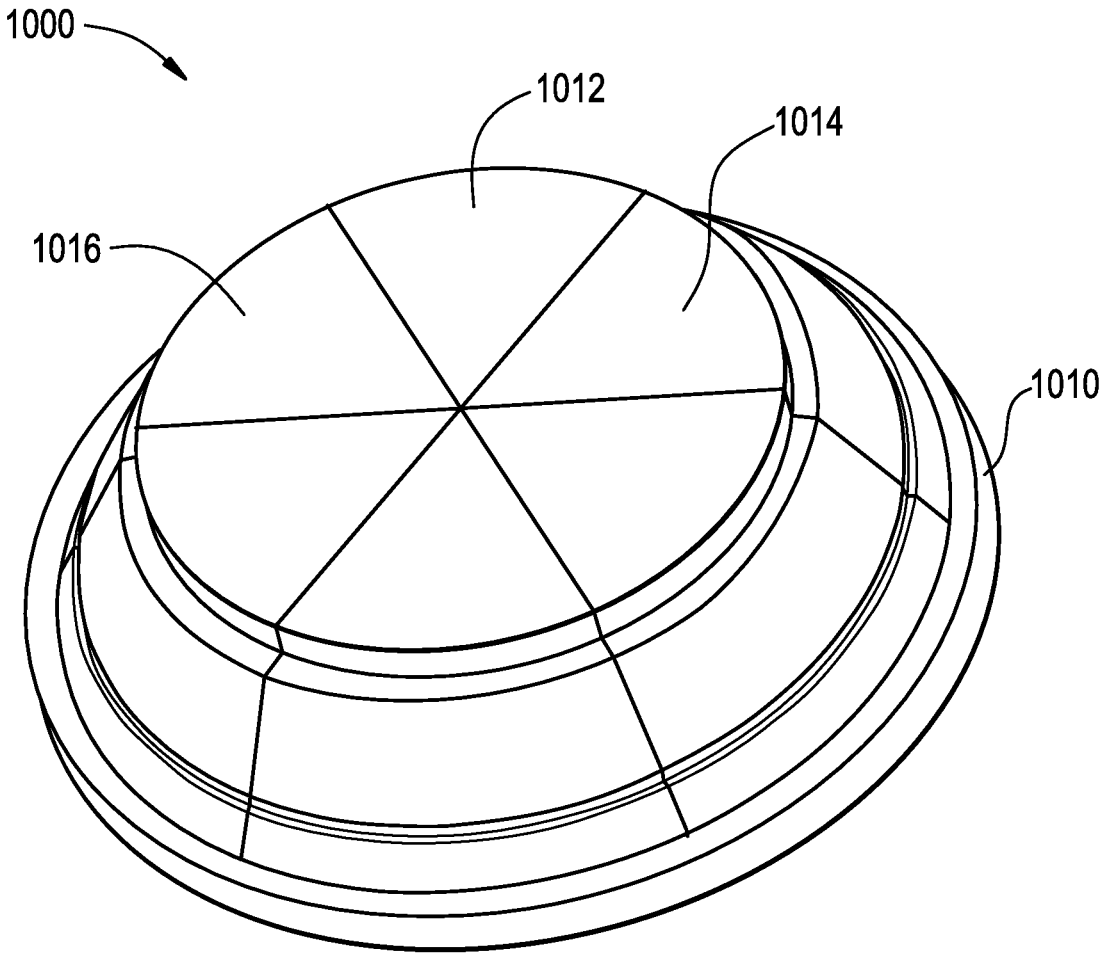
FIG. 10 depicts a blocking element, according to an embodiment.

FIG. 10 depicts blocking element 1000, according to an embodiment. Elements depicted in FIG. 10 may be described above. For the sake of brevity, another description of those elements is omitted.

As depicted in FIG. 10, blocking element 1000 may include a plurality of pie-shaped segments 1010, wherein the segments are symmetrical in shape. Edges of a first segment 1012 may be configured to receive forces from the edges of the adjacent segments 1014, 1016 to secure blocking element 1000 together in a self-supported fashion. The forces applied by the edges of the segments 1010 against each other may be greater than a hydrostatic pressure. This may allow blocking element 1000 to retain its shape until pressure is applied to blocking element. Responsive to pressure being applied to blocking element 1000 being greater than the contact pressure of segments 1010 against each other, blocking element 1000 may shear into a plurality of symmetrical segments.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed:

1. A system for temporarily sealing a wellbore:

a dissolvable blocking object with a body being a unitary device being uniformly formed of dissolvable material, the body configured to extend across a first inner diameter of casing to isolate a first area of a well from a second area of the well, the body of the dissolvable blocking object including a first portion and a second portion, the first portion being a radial rim being coupled to casing and the second portion being spherical in shape;

grooves extending from an outer surface of the dissolvable blocking object into the body of the dissolvable blocking object, wherein the grooves decrease the thickness across the dissolvable blocking object to create breaking points, wherein a first groove separates the first portion and the second portion of the body of the dissolvable blocking object.

2. The system of claim 1, wherein an upper surface of the dissolvable blocking object is coated to reduce a rate of dissolution associated with the dissolvable blocking object.

3. The system of claim 1, the grooves include a second groove, the second groove extending into the second portion, the first groove and the second groove do not extend into an entirety of the thickness of the body of the dissolvable blocking object across a first axis, the first and second groove do extend across an entirety of the thickness of the body of the dissolvable blocking object across a second axis, wherein the first groove minimizes the thickness of the body of the dissolvable blocking object, the first axis being perpendicular to the second axis.

4. The system of claim 3, wherein the first groove has a first pressure threshold and the second groove has a second pressure threshold, wherein the dissolvable blocking object is configured to shear at the first groove responsive to a pressure differential across the first groove being greater than the first pressure threshold.

5. The system of claim 3, the first portion being configured to be positioned on a ledge, the ledge having a second inner diameter, the second inner diameter being smaller than the first inner diameter.

6. The system of claim 5, wherein the first groove forms a shear point between the first portion and the second portion along the first axis.

7. The system of claim 6, further comprising: a casing collar with a holding element, the holding element configured to apply a force on the first portion of the dissolvable blocking object towards the ledge to secure the first portion of the dissolvable blocking object in place.

8. The system of claim 7, wherein the first portion of the dissolvable blocking object is configured to remain on the ledge after the second portion of the dissolvable blocking object moves downhole.

9. The system of claim 5, wherein the first portion has a variable and continually and incrementally increasing diameter based on a rate of dissolution of the first portion after the first portion is decoupled from the second portion.

10. The system of claim 5, wherein the second portion has a variable and continually and incrementally decreasing diameter based on a rate of dissolution of the second portion after the first portion is decoupled from the second portion.

11. The system of claim 1, wherein the dissolvable blocking object is directly coupled to a casing collar.

12. A method for temporarily sealing a wellbore:

positioning a dissolvable blocking object with a body being a unitary device being uniformly formed of dissolvable material, the body of the dissolvable blocking object extending across a first inner diameter of casing within the wellbore to isolate a first area of a well from a second area of the wed, the body of the dissolvable blocking object including a first portion and a second portion, the first portion being a radial rim and the second portion being spherical in shape;

coupling the first portion to casing;

forming grooves on the dissolvable blocking object, the grooves extending from an outer surface of the dissolvable blocking object into the body of the dissolvable blocking object, wherein the grooves decrease a thickness across the dissolvable blocking object to create breaking points, wherein a first groove separates the first portion and the second portion of the body of the dissolvable blocking object.

13. The method of claim 12, further comprising: coating an upper surface of the dissolvable blocking object to reduce a rate of dissolution associated with the dissolvable blocking object.

14. The method of claim 12, wherein the grooves include a second groove extending into the second portion, wherein the first groove minimizes the thickness of the dissolvable blocking object, wherein the first groove and the second groove do not extend across an entirety of the thickness of the body of the dissolvable blocking object across a first axis, the first and second groove do extend across an entirety of the thickness of the body of the dissolvable blocking object across a second axis, the first axis being perpendicular to the second axis.

15. The method of claim 14, wherein the first groove has a first pressure threshold and the second groove has a second pressure threshold, increasing a pressure differential to be greater than the first pressure threshold;

shearing the dissolvable blocking object at the first groove responsive to a pressure differential across the first groove being greater than the first pressure threshold.

16. The method of claim 15, further comprising positioning the first portion on a ledge, the ledge having a second inner diameter, the second inner diameter being smaller than the first inner diameter.

17. The method of claim 16, wherein the first groove forms a shear point between the first portion and the second portion along the first axis.

18. The method of claim 17, further comprising:

applying a force on the first portion of the dissolvable blocking object towards the ledge via a holding element to secure the first portion of the dissolvable blocking object in place.

19. The method of claim 18, further comprising:

moving the second portion of the dissolvable blocking object downhole;

holding the first portion of the dissolvable blocking object on the ledge after the second portion of the dissolvable blocking-object moves downhole.

20. The method of claim 17, further comprising:

continually and incrementally increasing a size of a diameter of the first portion based on a rate of dissolution of the first portion after the first portion is decoupled from the second portion.

21. The method of claim 17, further comprising:

continually and incrementally decreasing a size of a diameter of the second portion based on a rate of dissolution of the second portion after the first portion is decoupled from the second portion.

22. The method of claim 12, further comprising:

directly coupling the dissolvable blocking-object to a casing collar.

* * * * *